US010000985B2

(12) United States Patent
Jones et al.

(10) Patent No.: US 10,000,985 B2
(45) Date of Patent: Jun. 19, 2018

(54) PROTECTIVE SHEATH FOR LOGGING TOOLS

(71) Applicant: Halliburton Energy Services, Inc., Houston, TX (US)

(72) Inventors: Christopher Michael Jones, Houston, TX (US); Darren Gascooke, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 163 days.

(21) Appl. No.: 14/767,551

(22) PCT Filed: Apr. 8, 2013

(86) PCT No.: PCT/US2013/035619
§ 371 (c)(1),
(2) Date: Aug. 12, 2015

(87) PCT Pub. No.: WO2014/168605
PCT Pub. Date: Oct. 16, 2014

(65) Prior Publication Data

US 2016/0017679 A1 Jan. 21, 2016

(51) Int. Cl.

| | |
|---|---|
| ***E21B 31/00*** | (2006.01) |
| ***E21B 23/14*** | (2006.01) |
| ***E21B 17/10*** | (2006.01) |

(52) U.S. Cl.
CPC ..... *E21B 23/14* (2013.01); *E21B 17/1042* (2013.01); *E21B 17/1085* (2013.01); *E21B 31/00* (2013.01)

(58) Field of Classification Search
CPC ..... E21B 23/14; E21B 47/01
See application file for complete search history.

(56) References Cited

U.S. PATENT DOCUMENTS

| | | | |
|---|---|---|---|
| 4,602,690 | A | 1/1986 | Steiger |
| 5,216,242 | A | 6/1993 | Perry et al. |
| 5,605,192 | A | 2/1997 | Bjørnstad |
| 5,806,615 | A | 9/1998 | Appleton |
| 6,100,696 | A | 8/2000 | Sinclair |

(Continued)

FOREIGN PATENT DOCUMENTS

| | | |
|---|---|---|
| GB | 1580438 | * 12/1980 |
| WO | WO 2014/014438 | 1/2014 |

OTHER PUBLICATIONS

Australian Government IP Australia, Patent Examination Report No. 1, Australian Application No. 2013385822, dated Mar. 10, 2016, 3 pages.

(Continued)

*Primary Examiner* — Sean D Andrish
(74) *Attorney, Agent, or Firm* — Scott Richardson; Parker Justiss, P.C.

(57) ABSTRACT

A slip cover for downhole logging tools to prevent the tools from becoming lodged during extraction and a method of retrieving a lodged logging tool in a wellbore are disclosed. In some implementations, the slip cover may include a generally cylindrical polymeric sleeve having an inside diameter greater than an outside diameter of a generally cylindrical well logging tool to which the sleeve is to be applied and having one or more perforations disposed therein.

15 Claims, 5 Drawing Sheets

(56) References Cited

U.S. PATENT DOCUMENTS

| | | | |
|---|---|---|---|
| 6,315,041 | B1 | 11/2001 | Carlisle et al. |
| 7,299,885 | B2 | 11/2007 | Baird |
| 7,789,148 | B2 | 9/2010 | Rayssiguier et al. |
| 2005/0173185 | A1 | 8/2005 | Pabon et al. |
| 2005/0284624 | A1 | 12/2005 | Libby et al. |
| 2009/0211770 | A1 | 4/2009 | Nutley et al. |
| 2011/0048801 | A1 | 3/2011 | Jacob |
| 2011/0139438 | A1 | 6/2011 | Nold et al. |
| 2012/0097385 | A1 | 4/2012 | Villareal et al. |
| 2012/0180562 | A1 | 7/2012 | Sorbier et al. |

OTHER PUBLICATIONS

Partial Supplementary European Search Report, European Application No. 13881976.8, dated Feb. 24, 2016, 7 pages.
Extended European Search Report, European Application No. 13881976.8, dated Apr. 6, 2016, 11 pages.
PCT International Preliminary Report on Patentability, PCT/US2013/035619, dated Oct. 22, 2015, 10 pages.
Authorized officer Lee, Jong Kyung, International Search Report and Written Opinion in Application No. PCT/US2013/035619, dated Jan. 8, 2014, 14 pages.

* cited by examiner

PROTECTIVE SHEATH FOR LOGGING TOOLS

TECHNICAL FIELD

This disclosure relates to a method and assembly for a slip cover for downhole logging tools to prevent the tools from becoming lodged during extraction from the wellbore.

BACKGROUND

In oil and gas exploration it is important to obtain diagnostic evaluation logs of geological formations penetrated by a wellbore drilled for the purpose of extracting oil and gas products from a subterranean reservoir. Diagnostic evaluation well logs are generated by data obtained by diagnostic tools (referred to in the industry as logging tools) that are lowered into the wellbore and passed across geologic formations that may contain hydrocarbon substances. Examples of well logs and logging tools are known in the art. Examples of such diagnostic well logs include neutron logs, gamma ray logs, resistivity logs and acoustic logs.

Logging tools frequently are used for log data acquisition in a wellbore by logging in an upward (up hole) direction, from a bottom portion of the wellbore to an upper portion of the wellbore. The logging tools, therefore, need first be conveyed to the bottom portion of the wellbore and then pulled upwards through the wellbore. In many instances, wellbores can be highly deviated, or can include a substantially horizontal section.

During drilling, drilling mud fills the borehole. The pressure of the drilling mud is maintained at a pressure greater than that of the formation to keep the formation fluid within the formation. The drilling mud contains solid particles that build up on the wellbore and form a mudcake. The differential pressure used during drilling is generally maintained sufficient to stop an inflow of oil or gas into the wellbore during drilling operation which under certain conditions could result in an uncontrolled well (e.g., a "blow out").

As the logging tool is lowered or raised within the formation, a flow of fluid occurs around the tool. This flow can dislodge the mudcake, and the tool can become lodged against one of the geologic formations because of differential pressure between the wellbore and the formation. Several factors increase the likelihood of sticking, including tool length, high permeability of the reservoir, deviated wellbores, and poorly formed mudcakes. In addition, the longer a tool stops within a wellbore, the greater the likelihood of the tool becoming lodged. Further, the wire or cable used to raise and lower the logging tool can become lodged in a wellbore. Although it does not have as great a cylindrical surface area as a logging tool, the wire has much more length. An added complication is that attempts to pull the stuck wire out of the formation can result in the wire beginning to cut into the formation (especially when the wellbore is deviated from vertical), which makes the wire—and the tool—lodged more tightly.

Current methods to address sticking of tools as a result of differential pressure are primarily preventative measures. These efforts include recirculating the mud to rebuild the mudcake and centralizing the tool. After a tool has become lodged, breakaways located on the tool itself are used. The use of the breakaways, however, only results in the retrieval of part of the tool, rather than the entire tool. The remaining portion of the tool can result in potential future problems.

SUMMARY

The present disclosure, in one embodiment, is directed to a downhole cover for a well logging cable. The downhole cover, in this embodiment, includes a first generally cylindrical polymeric sleeve, the first generally cylindrical polymeric sleeve having an inside diameter greater than an outside diameter of a generally cylindrical well logging tool to which the sleeve is to be applied and the first generally cylindrical polymeric sleeve having one or more first tearable perforations disposed therein. In this embodiment, the downhole cover further includes a second generally cylindrical polymeric sleeve, the second generally cylindrical polymeric sleeve having an inside diameter greater than an outside diameter of a cable for a well logging tool and the second generally cylindrical polymeric sleeve having one or more second tearable perforations disposed therein.

DETAILED DESCRIPTION

The present disclosure describes a protective sheath to be added to downhole tools to address sticking of the logging tool as a result of differential pressure or other reasons. The sheath may be constructed of a Mylar-type material that may be perforated along the length of the sheath. If a tool begins to become lodged as a result of differential pressure (or some other reason), the sheath may tear along the perforation to enable the tool to be retrieved more easily. In some implementations, the sheath may include multiple layers to prevent sticking at multiple sampling points. In addition to using the sheath on the downhole tools, a sheath may be added to the wire to prevent the wire from becoming lodged in the wellbore.

In some cases, the sheath may be applied to individual sections of a tool before it is assembled and inserted into a wellbore. The sheath may be formed or "shrink-wrapped" to enable a tight fit around the tool. In some cases, the perforation may be added to the sheath after it is installed on the tool. In some instances, the number of sheath layers may be chosen according to the number of anticipated stops the tool will make in the wellbore, for pressure points, and/or for sampling points and/or separate sections of the wellbore to be logged.

The perforation(s) may be added to each sheath individually before the next layer is added. In some cases, the perforations of different layers may be placed in different spots to avoid tearing multiple layers at once when the tool is dislodged. A non-stick substance may also be added between the layers of sheathing, such as talc, cornstarch, a spray-on lubricant, or any other suitable non-stick substance. The non-stick substance may ensure that when the tool is ripped away from the sheathing in a stuck-tool event, only one sheath layer is ripped away. The sheathing for the wire may either be shrink-wrapped at the drill site, or an entire spool of wire may be pre-sheathed.

In some implementation, the sheath may cover part of an individual tool or tool string. For example, the sheath may be fitted to a single section of a tool on the tool string. In some cases, the sheath may include one or more preformed access cutaways (openings) to allow access to a portion of the tool or tools without removing the sheath. In one example, the cutaways may be used to access the tool to perform maintenance without having to remove the sheath. The preformed cutaways may also be used so that the tool can access the wellbore area around the tool through the sheath, such as, for example, a probe section of a formation tester accessing the formation, a stabilization portion of a formation tester accessing the formation, a caliper portion accessing the area around the tool, a packer portion accessing the area around the tool, or any other suitable application. In some implementations, the cutaways may be formed after installation. The cutaways may also be formed prior to the sheath being installed on the tool.

Figure 1:
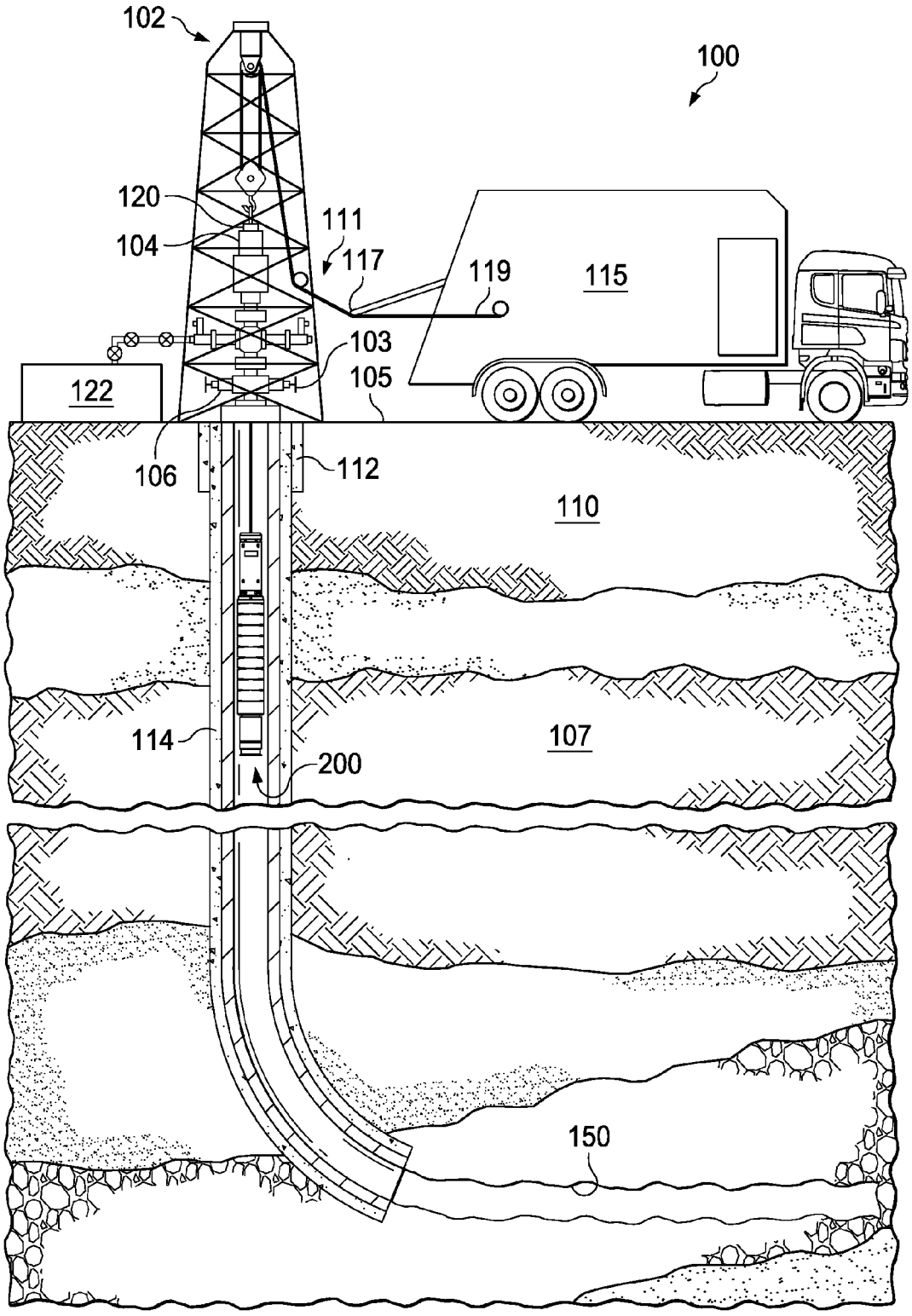
FIG. 1 illustrates operations of a logging tool conveying system.

FIG. 1 illustrates a system 100 including a tool string 200 operating inside a wellbore 150 according to various aspects of the present disclosure. The system 100 includes surface equipment above the ground surface 105 and wellbore 150 and its related equipment and instruments below the ground surface 105. In general, surface equipment provides power, material, and structural support for the operation of the tool string 200. In the embodiment illustrated in the side schematic of FIG. 1, the surface equipment includes a drilling rig 102 and associated equipment, and a data logging and control truck 115. The drilling rig 102 may include equipment such as a rig pump 122 disposed proximal to the drilling rig 102. The drilling rig 102 can include equipment used when a well is being logged or later perforated such as a tool lubrication assembly 104 and a pack off pump 120. In some implementations a blowout preventer 103 will be attached to a casing head 106 that is attached to an upper end of a well casing 112. The rig pump 122 provides pressurized drilling fluid to the drilling rig 102 and some of its associated equipment. A wireline and control truck 115 monitors the data logging operation and receives and stores logging data from the logging tools and/or controls and directs logging operations. Below the drilling rig 102 is the wellbore 150 extending from the surface 105 into the earth 110 and passing through a plurality of subterranean geologic formations 107. The wellbore 150 penetrates through the geologic formations 107 and in some implementations forms a deviated path, which may include a substantially horizontal section as illustrated in FIG. 1. The wellbore 150 may be reinforced with one or more casing strings 112 and 114.

The tool string 200 may be attached to a cable/wireline 111. The cable 111 is spooled out at the surface by the control truck 115. A cable tension sensing device 117 is located at the surface and provides cable tension data to control truck 115. A speed sensor device 119 located at the surface provides surface cable speed data to control truck. In some implementations the tool string 200 may not have sufficient weight that gravity will convey the tool string 200 down the wellbore 150 and may need the assistance of pumping fluid behind the tool.

Figure 2:
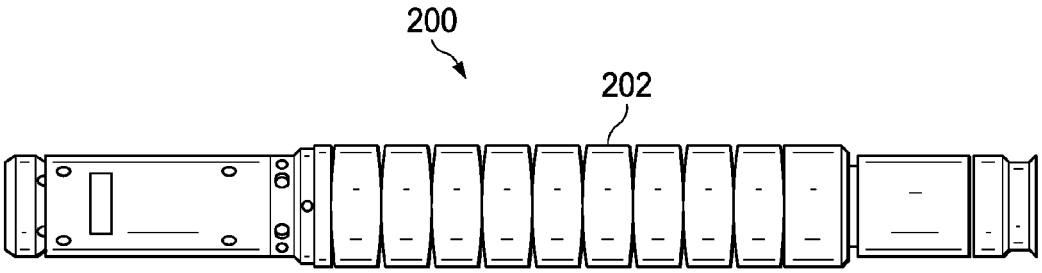
FIG. 2 illustrates an example tool string.

FIG. 2 illustrates an example tool string 200 including a single logging tool 202. In some cases, the logging tool 202 may be a neutron logging tool, gamma ray logging tool, resistivity logging tool, acoustic logging tool, or any other suitable logging tool or other type of tool. In some cases, a tool string may include only a single tool as depicted in FIG. 2, or may include multiple tools (such as the string shown in FIG. 4). For simplicity, the example tool strings in FIG. 2 and FIG. 3 include only the single logging tool 202.

Figure 3:
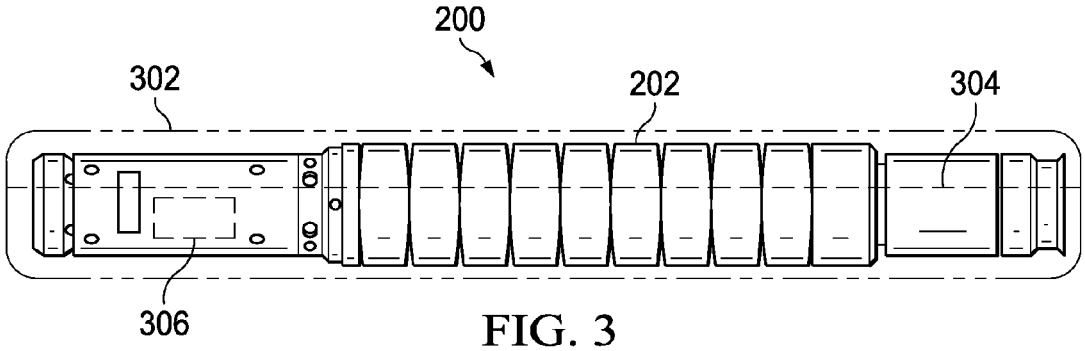
FIG. 3 illustrates the example tool string of FIG. 2 with an installed protective sheath installed according to various aspects of the present disclosure.

FIG. 3 illustrates the example tool section 200 of FIG. 2 with a protective sheath installed according to various aspects of the present disclosure. In the illustrated implementation, the logging tool 202 has been fitted with a protective sheath 302 to prevent the logging tool 202 from becoming lodged in a wellbore. The protective sheath 302 includes one or more perforations 304 operable to separate when the lodged tool is pulled upwards through the wellbore. In such a case, the perforation will separate allowing the logging tool 202 to slide from within the protective sheath 302, which may remain lodged against the side of the wellbore. Although the protective sheath 302 is illustrated with only a single layer, in some cases the protective sheath 302 may include multiple layers each having a perforation. In such cases, when the logging tool 202 is dislodged from the wellbore, only a single layer of the protective sheath 302 may tear off and the other layers will remain in place on the logging tool 202. If the logging tool 202 becomes lodged in the wellbore again, the process is repeated with the next layer of the protective sheath 302. In some cases, the perforations of the various layers of protective sheath 302 may be offset from one another so that multiple layers of the sheath do not tear off each time the logging tool 202 must be dislodged. In some cases, the layers of the sheath 302 may be formed sequentially by repeating the processes described above (shrink-wrapping, etc.) for each layer. In such cases, the perforations may be applied to each layer before an additional layer is added over it. In some cases, a lubricant may be applied between the layers to ensure that the logging tool 202 and the remaining layers of the sheath 302 are easily removed from the layer being removed when dislodging the logging tool 202. This lubricant may include cornstarch, talc, a spray-on lubricant, or any other suitable non-stick substance.

In some cases, the sheath 302 may be composed of different materials including, but not limited to, Mylar®, rubber, nylon, plastic or any other suitable material. The sheath 302 may be installed by forming or "shrink-wrapping" the sheath 302 onto the logging tool 202. In some cases, this process may involve applying heat to the protective sheath 302 once it is placed over the logging tool 202, causing the sheath 302 to conform to the outer surface of the logging tool 202. In some instances, the sheath 302 may also be applied as a spray-on material. In the illustrated implementation, the protective sheath 302 has a cylindrical shape to match that of logging tool 202. In some cases, the sheath 302 may be formed into a different shape to match the shape of the tool it is to protect.

The illustrated sheath 302 also includes an access cutaway 306. In some implementations, the access cutaway 306 is a preformed cutaway in the sheath 302 allowing access to the tool through the sheath 302. The access cutaway 306 may be a perforated section in the sheath 302 that can be removed to access the logging tool 202. The access cutaway 306 may also allow the logging tool 202 to access the well bore through the sheath 302. In some implementations, the access cutaway 306 is preformed in the sheath prior to installation on the logging tool 202. The access cutaway 306 may also be formed after installation of the sheath 302.

Figure 4:
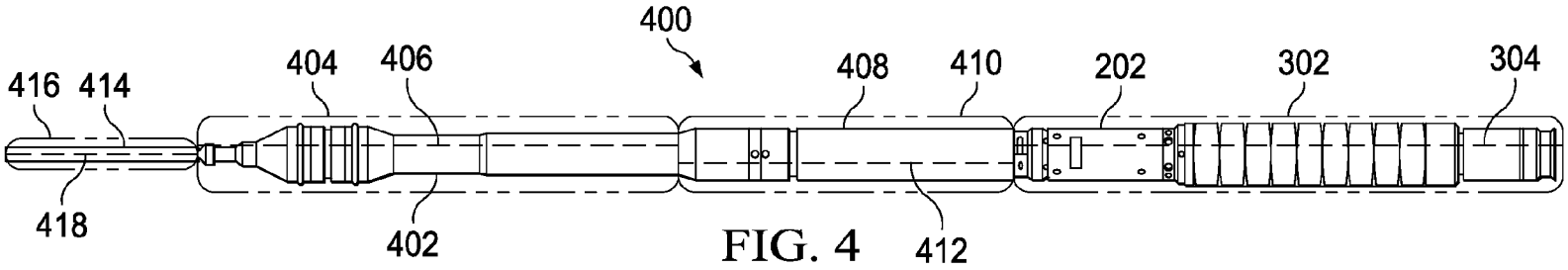
FIG. 4 illustrates an example tool string including multiple protective sheaths installed according to various aspects of the present disclosure.

FIG. 4 illustrates an example tool string 400 including multiple protective sheaths installed according to various aspects of the present disclosure. The example tool string 400 includes the logging tool 202 with installed protective sheath 302 including one or more perforations 304, as described previously in FIG. 3. In the illustrated implementation, the logging tool 202 is part of a larger example tool string 400 including tools 402 and 408. The depicted tool string 400 is attached to cable/wireline 414 for guiding the tool string 400 through a wellbore (see FIG. 1 cable/wireline 111). In the illustrated implementation, tool 402 includes a protective sheath 404 with one or more perforations 406, tool 408 includes a protective sheath 410 with one or more perforations 412, and cable/wireline 414 includes a protective sheath 416 with one or more perforations 418. Although in the illustrated implementation each tool of the example tool string 400 includes a dedicated sheath, in some cases a single sheath may be used to protect the entire tool string 400 instead of separate sheaths. The perforations 304, 406, 412 and 418 of the different sheaths are shown offset from each other. In other instances, the perforations may be aligned with one another. In some cases, the tool string 400 may include other tools that do not have associated sheaths. The sheaths for the different tools in tool string 400 may also be formed from different materials and may have different numbers of layers.

Figure 5:
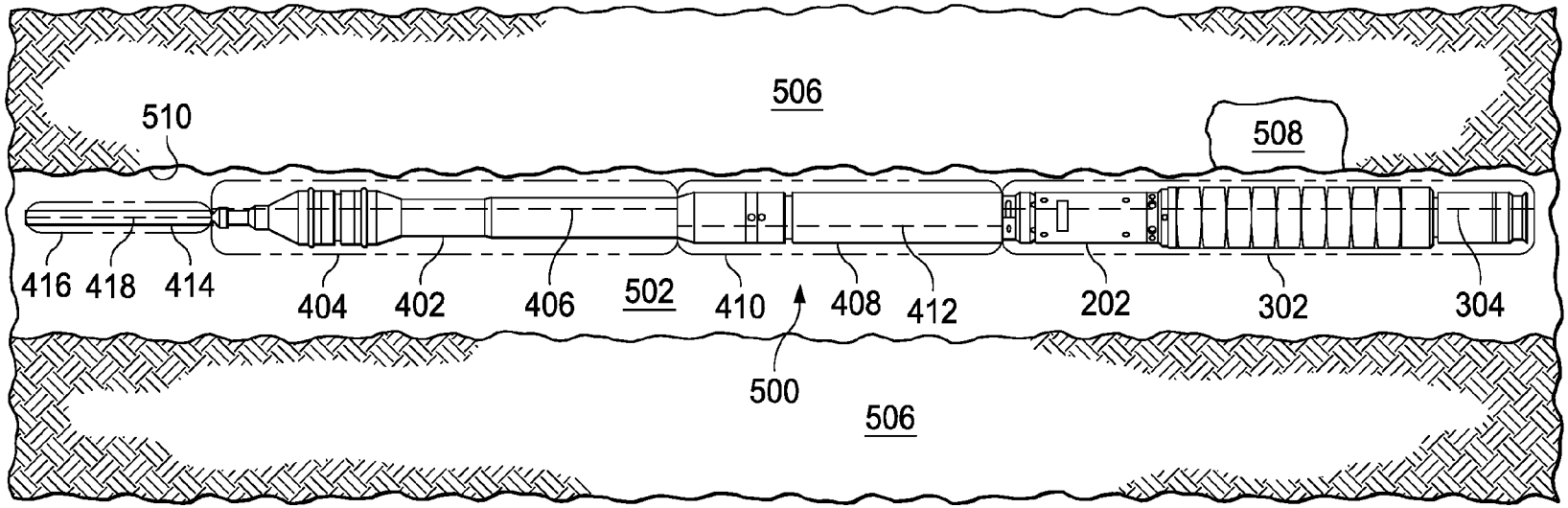
FIG. 5 illustrates an example tool string with installed protective sheaths that has become lodged in operation inside a wellbore.

FIG. 5 illustrates an example tool string 500 with installed protective sheaths that has become lodged in operation inside a wellbore. The tool string 500 includes the logging tool 202, protective sheath 302 and one or more perforations 304 previously discussed. The tool string 500 is attached to cable/wireline 414, which is operable to move the tool string 500 through wellbore 502. In some cases, the wire 414 may include a protective sheath as previously discussed. The wellbore 502 is formed through geologic formation 506. A pressure differential area 508 is shown in which the tool string 500 has become lodged. Such a pressure differential area 508 may be formed when the pressure created by drilling mud pumped into the wellbore 502 is greater than the pressure in a region of the formation 506. Such a pressure differential may cause the tool string 500 to become lodged or stuck against the wall 510 of the wellbore 502. In some cases, the pressure differential area 508 may be caused when the mudcake formed by the buildup of solid particles of drilling mud on the walls of the wellbore 502 breaks off, causing a portion of the formation 506 to become exposed. Several factors increase the likelihood of the tool string 500 becoming lodged, including tool length, high permeability of the formation 506, highly-deviated wellbores, and poorly formed mudcakes. In addition, the longer that the tool string 500 stops and/or the slower the tool is moving within the wellbore 502, the greater the likelihood of the tool string 500 becoming stuck due to differential pressure.

Figure 6:
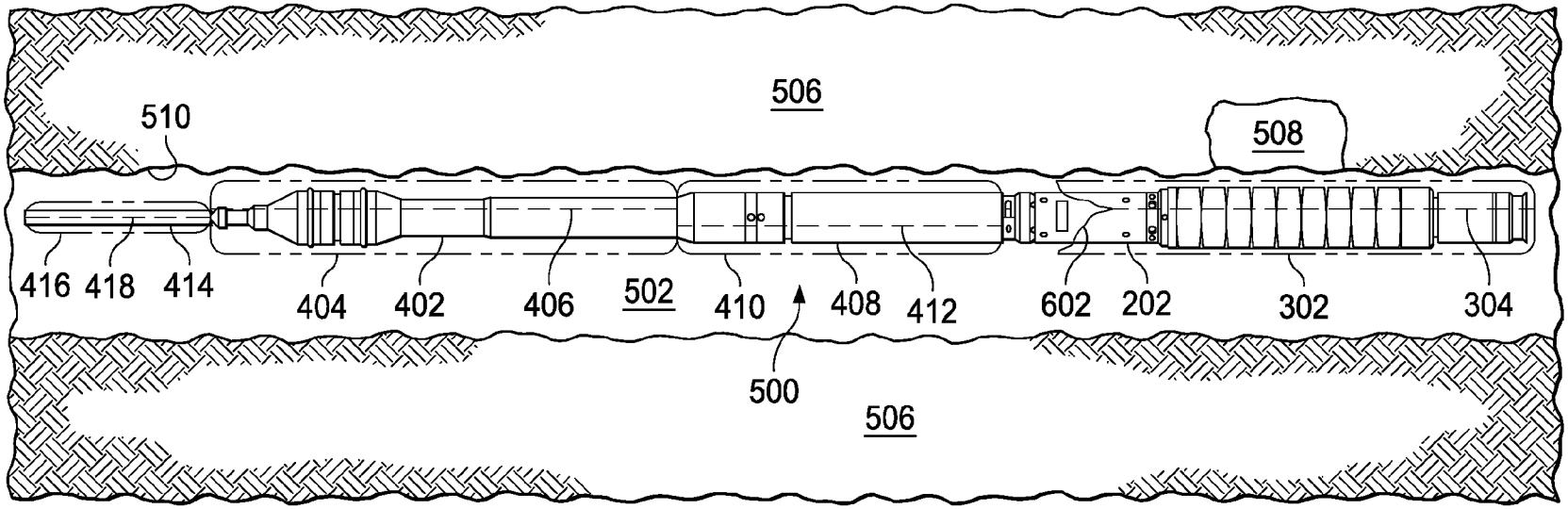
FIG. 6 illustrates the example tool string of FIG. 5 being freed by operation of the installed protective sheath.

FIG. 6 illustrates the example tool string 500 of FIG. 5 being freed by operation of the installed protective sheath. The illustrated tool string 500 has been separated from protective sheath 302 by force applied to cable/wireline 504. The sheath 302 has torn along perforation 304 (at tear 602), allowing the logging tool 202 to become dislodged from pressure differential area 508 and to emerge from sheath 302. The sheath 302 remains lodged in the pressure differential area 508 of formation 506. In some cases, the sheath 302 may include additional layers beneath to layer lodged in pressure differential area 508.

Figure 7:
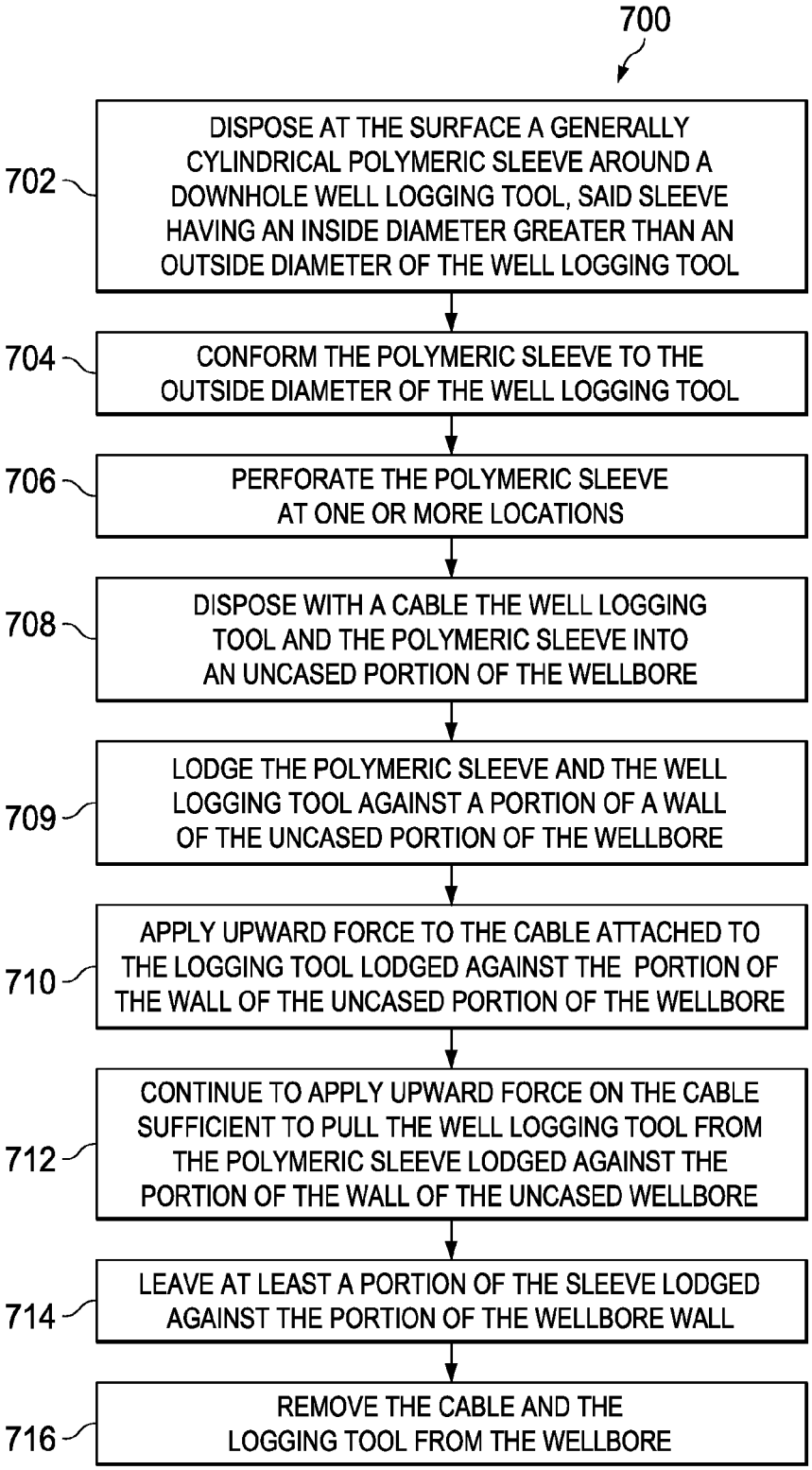
FIG. 7 illustrates an example method for installing and utilizing a protective sheath for dislodging a logging tool lodged in a wellbore.

FIG. 7 illustrates an example method 700 for installing and utilizing a protective sheath for dislodging a logging tool lodged in a wellbore. At 702, a generally cylindrical polymeric sleeve is disposed around a downhole well logging tool at the surface prior to insertion into a wellbore, the sleeve having an inside diameter greater than an outside diameter of the logging tool.

At 704, the sleeve is conformed to the outside diameter of the logging tool. In some cases, the sleeve may be conformed to the logging tool by any appropriate process including, but not limited to, shrink wrapping, heating, spray, vacuum sealing, molding, or any other appropriate process or combination of processes.

At 706, the sleeve is perforated at one or more locations. In some instances, the perforation(s) may be added by an automatic tool. The perforation(s) may also be added to the sleeve manually, or the sleeve may be pre-perforated. In some cases, the perforation(s) may run longitudinally down the length of the tool, while in other cases the perforation(s) may run laterally to a longitudinal axis of the tool. In other cases, a combination of longitudinal and lateral perforations may be added. The perforation(s) may also be formed in a complex pattern specifically formulated for the particular tools to be protected, the type of drilling mud used, the wellbore, the type of formation, or to any other variable. In some cases, the sleeve may not include any perforation. In some instances, the sleeve may include one or more rows of perforations. In some cases, the rows may be linear rows. The rows may also be curved, spiral-shaped, or any other suitable orientation.

At 708, the logging tool with the polymeric sleeve is disposed with a cable into an uncased portion of the wellbore. In some cases, the logging tool may be pumped down into the wellbore, while in other cases the force of gravity may be used lower the logging tool. In some cases, the wellbore may be deviated. At 709, the polymeric sleeve and the well logging tool are lodged against a portion of a wall of the uncased portion of the wellbore. In some cases, the polymeric sleeve and well logging tool are lodged by differential pressure between the wellbore and the geologic formation. The polymeric sleeve and well logging tool may also be lodged on jagged edges of the wall of the uncased wellbore, or may be lodged in any other manner. At 710, upward force is applied to the cable attached to the logging tool that has become lodged against a wall of the uncased wellbore. In some cases, the upward force on the wire is applied by a truck or rig at the surface.

At 712, upward force is continuously applied on the cable sufficient to pull the well logging tool from the polymeric sleeve lodged against the portion of the wall of the uncased wellbore. In some cases, the upward force is increased in response to an indication that the tool has become lodged in the wellbore. This increase in upward force may cause the perforation on the sleeve to separate, allowing the logging tool be pulled from the sleeve.

At 714, at least a portion of the sleeve is left lodged against the wellbore wall. In some cases, the sleeve may be held in place by differential pressure, while in other cases, the sleeve may be lodged on an obstruction on the wellbore wall. At 716, the cable and logging tool are removed from the wellbore A number of implementations have been described. Nevertheless, it will be understood that various modifications may be made. Further, the method 700 may include fewer steps than those illustrated or more steps than those illustrated. In addition, the illustrated steps of the method 700 may be performed in the respective orders illustrated or in different orders than that illustrated. As a specific example, the method 700 may be performed simultaneously (e.g., substantially or otherwise). Other variations in the order of steps are also possible. Accordingly, other implementations are within the scope of the following claims.

What is claimed is:

1. A method of retrieving a downhole well logging tool from a wellbore including:

disposing at a surface a generally cylindrical polymeric sleeve around a downhole well logging tool, said sleeve having an inside diameter greater than an outside diameter of the well logging tool;

conforming the polymeric sleeve to the outside diameter of the well logging tool;

perforating the polymeric sleeve at one or more locations;

disposing with a cable the well logging tool and the polymeric sleeve into an uncased portion of the wellbore;

lodging the polymeric sleeve and the well logging tool against a portion of a wall of the uncased portion of the wellbore;

applying upward force to the cable attached to the logging tool lodged against the portion of the wall of the uncased portion of the wellbore;

continuing to apply upward force on the cable sufficient to tear the polymeric sleeve along perforations therein to separate the well logging tool from the polymeric sleeve lodged against the portion of the wall of the uncased wellbore;

leaving at least a portion of the sleeve lodged against the portion of the wellbore wall; and removing the cable and the logging tool from the wellbore.

2. The method of claim 1 wherein leaving at least a portion of the polymeric sleeve lodged against the portion of the wall of the uncased wellbore includes applying sufficient upward force on the cable to tear the polymeric sleeve at the one or more perforations.

3. The method of claim 1 further includes disposing at the surface at least one additional layer of polymeric material over a first layer of the polymeric sleeve.

4. The method of claim 3 wherein perforating the polymeric sleeve includes perforating the first layer with at least one row of perforations to form a perforated first layer and after perforating the first layer disposing a second layer of polymeric material and perforating the second layer of material in at least one row of perforations offset circumferentially from the row of perforations in the first layer.

5. The method of claim 4 further including disposing a non-stick substance between the first and second layers.

6. The method of claim 3 further including:

prior to removing the cable and the logging tool from the wellbore applying upward force to the cable attached to the wellbore logging tool that has become subsequently lodged at a second location in the wellbore spaced apart from a first location where the wellbore logging tool was previously lodged against a portion of the wall of the uncased wellbore;

continuing to apply upward force on the cable sufficient to pull the wellbore logging tool from a second layer of the polymeric sleeve that is lodged against the wall of the uncased wellbore at a second location; and leaving at least a portion of the second layer of the sleeve lodged against the second location in the wellbore.

7. The method of claim 1 further including preforming at least one access cutaway section in the polymeric sleeve before the sleeve is disposed on the downhole well logging tool.

8. The method of claim 7 further including accessing a portion of the well logging tool via the access cutaway section before the tool is disposed in the well bore.

9. A method of freeing a lodged logging tool cable in a wellbore including;

disposing at a surface a generally cylindrical polymeric sleeve around the cable said sleeve having an inside diameter greater than an outside diameter of the cable;

conforming the sleeve to the outside diameter of the cable;

perforating the sleeve at one or more locations;

disposing the cable and the polymeric sleeve into an uncased portion of the wellbore;

lodging the polymeric sleeve and the cable against a portion of a wall of the uncased wellbore;

applying upward force to the cable lodged against the portion of the wall of the uncased wellbore;

continuing to apply upward force on the cable sufficient to pull the cable from the sleeve that is lodged to the portion of the wall of the uncased wellbore;

leaving at least a portion of the polymeric sleeve lodged to the portion of the wellbore wall; and removing the cable from the wellbore.

10. The method of claim 9 wherein leaving at least a portion of the polymeric sleeve lodged to the wellbore includes applying sufficient upward force on the cable to tear the polymeric sleeve at the one or more perforations.

11. The method of claim 9 further including disposing at the surface at least one additional layer of polymeric material over a first layer of the polymeric sleeve.

12. The method of claim 11 wherein perforating the polymeric sleeve includes perforating the first layer with at least one row of perforations to form a perforated first layer and after perforating the first layer disposing a second layer of polymeric material and perforating the second layer of material in at least one row of perforations offset circumferentially from the row of perforations in the first layer.

13. The method of claim 12 further including disposing a non-stick substance between the first and second layers.

14. The method of claim 11 further including:

prior to removing the cable from the wellbore applying upward force to the cable that has become subsequently lodged at a second location in the wellbore spaced apart from a first location where the cable was previously lodged against the portion of the wall of the uncased wellbore;

continuing to apply upward force on the cable sufficient to pull the wellbore tool from a second layer of the polymeric sleeve that is lodged against the second location in the wellbore; and leaving at least a portion of the second layer of the polymeric sleeve lodged against the second location in the wellbore.

15. The method of claim 9 further including preforming at least one access cutaway section in the polymeric sleeve before the sleeve is disposed on the downhole well logging tool and accessing a portion of the well bore by a portion of the well logging tool via the access cutaway section.

* * * * *